US009795821B2

(12) United States Patent
Feldman

(10) Patent No.: US 9,795,821 B2
(45) Date of Patent: Oct. 24, 2017

(54) GARMENT WITH WEIGHTED ELASTIC PORTION

(71) Applicant: Doree Feldman, Princeton, NJ (US)

(72) Inventor: Doree Feldman, Princeton, NJ (US)

( * ) Notice: Subject to any disclaimer, the term of this patent is extended or adjusted under 35 U.S.C. 154(b) by 0 days.

(21) Appl. No.: 14/854,026

(22) Filed: Sep. 14, 2015

(65) Prior Publication Data

US 2016/0082302 A1 Mar. 24, 2016

Related U.S. Application Data

(60) Provisional application No. 62/052,998, filed on Sep. 19, 2014.

(51) Int. Cl.

| | |
|---|---|
| ***A63B 21/065*** | (2006.01) |
| ***A41C 3/00*** | (2006.01) |
| ***A41D 1/04*** | (2006.01) |
| ***A63B 21/00*** | (2006.01) |

(52) U.S. Cl.

CPC ..... *A63B 21/065* (2013.01); *A41C 3/0057* (2013.01); *A41D 1/04* (2013.01); *A63B 21/4007* (2015.10); *A41D 2600/10* (2013.01)

(58) Field of Classification Search

CPC ..... A63B 21/065; A63B 21/4007; A63B 21/4005; A63B 21/4025

See application file for complete search history.

(56) References Cited

U.S. PATENT DOCUMENTS

| | | | | |
|---|---|---|---|---|
| 4,621,808 A | | 11/1986 | Orchard et al. | |
| 5,067,484 A | | 11/1991 | Hiemstra-Paez | |
| 5,120,288 A | | 6/1992 | Sinaki | |
| 5,144,694 A | | 9/1992 | Conrad Da oud et al. | |
| 5,211,163 A | | 5/1993 | Mortenson | |
| 6,005,041 A | * | 12/1999 | Cook | A63B 21/06 524/435 |
| 7,022,095 B2 | * | 4/2006 | Schneider | A63B 71/14 482/105 |
| 7,090,558 B2 | * | 8/2006 | Ott | A41C 3/0057 2/69 |
| 7,708,673 B2 | | 5/2010 | Gibson-Horn | |

(Continued)

FOREIGN PATENT DOCUMENTS

| | | |
|---|---|---|
| EP | 163505 B1 | 5/1989 |
| RU | 29473 U1 | 5/2003 |

OTHER PUBLICATIONS http://www.dictionary.com/browse/entrain?s=t, last visited Aug. 8, 2016.*

(Continued)

*Primary Examiner* — Sundhara Ganesan
*Assistant Examiner* — Rae Fischer
(74) *Attorney, Agent, or Firm* — Schwegman Lungberg & Woessner, P.A.

(57) ABSTRACT

A garment and portions of a garment presently disclosed contains a body having a front portion and a back portion, and a plurality of weighted inserts coupled with an elastic material, wherein the plurality of inserts are separated by a first distance when the garment is not being worn by a user, wherein the plurality of inserts are separated by a second distance when the garment is being worn by the user, wherein the second distance is greater than the first distance. Alternatively, the weights ma be fixed to the elastic.

21 Claims, 6 Drawing Sheets

(56) References Cited

U.S. PATENT DOCUMENTS

| | | | |
|---|---|---|---|
| 8,215,773 | B2 | 7/2012 | Gibson-Horn et al. |
| RE46,069 | E | 7/2016 | Gibsonhorn et al. |
| 2004/0259666 | A1 | 12/2004 | Bjugstad et al. |
| 2010/0248915 | A1 | 9/2010 | Gibson-Horn |

OTHER PUBLICATIONS

V M Pomeroy, B Evans, M Falconer, D Jones, E Hill, G Giakas; An exploration of the effects of weighted garments on balance and gait of stroke patients with residual disability; http://cre.sagepub.com/content/15/4/390.short; Sage Journal; Clin Rehabil Apr. 2001 vol. 15 No. 4 390397.

Greendale GA , Salem GJ, Young JT, Damesyn M, Marion M, Wang MY, Reuben DB.; A randomized trial of weighted vest use in ambulatory older adults: strength, performance, and quality of life outcomes.; http://www.ncbi.nlm.nih.gov/pubmed/10733058; Mar. 2000;Journal of the American Geriatrics Society.

Kaminsky, "W8FIT Weighted Activewear Apparel Launch—Yoga-Run-Dance," Kickstarter.com, Retrieved from < http://web.archive.org/web/20120429053558/http://www.kickstarter.com/projects/w8fit/w8fit-weighted-activewear-launch-yoga-run-dance? >, Nov. 2016, 7 pages.

* cited by examiner

FIG. 13 A
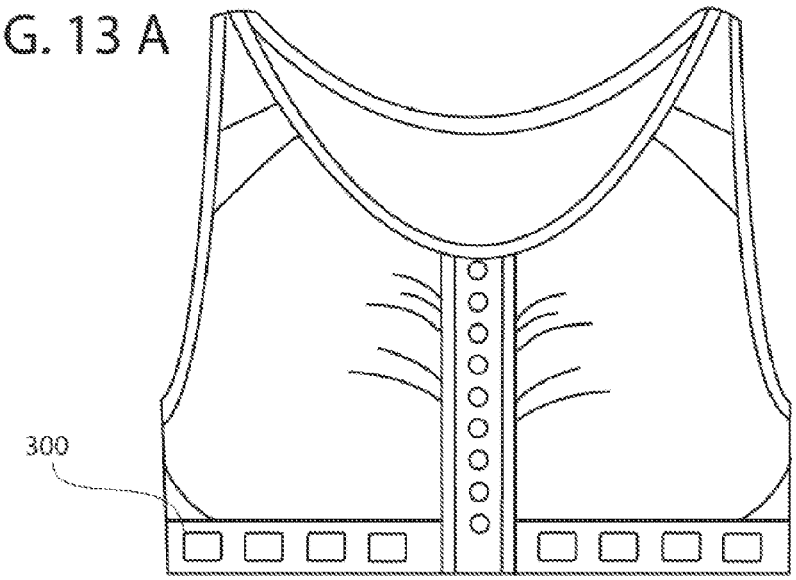
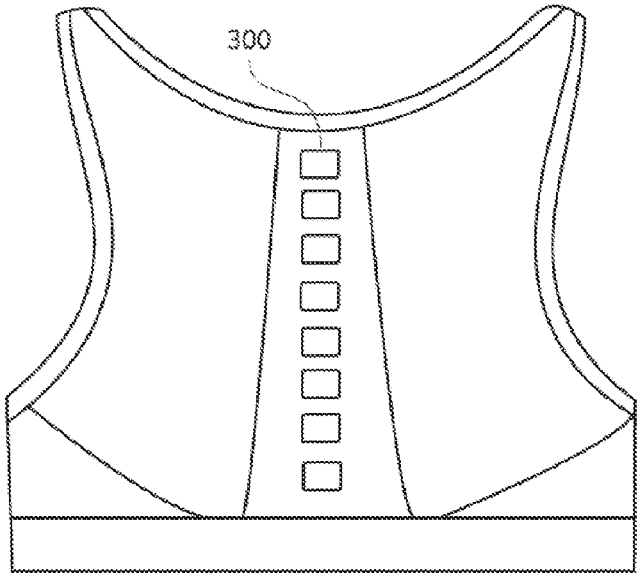
FIG. 13 B

GARMENT WITH WEIGHTED ELASTIC PORTION

This application claims the benefit of U.S. provisional application No. 62/052,998 by the same inventor, filed on Sep. 14, 2014 and hereby incorporates that application herein in its entirety.

FIELD

This disclosure relates to a garment or a portion of a garment having weights distributed along an elastic material.

BACKGROUND

There are numerous weighted garments used for exercising. However, many of the weighted garments have features limiting their use. Weighted garments for enhancing the effect of exercise, such as weighted vests, can hit hard against the body while the user is running and can be bulky. These and other characteristics can limit the time and occasion of use of these devices.

Also, these devices are not generally designed to be unobtrusively worn under street clothes to provide increased exertion during normal daily activities. There is a need for weighted garment technology that provides products that are comfortable to wear for long periods of time and that can be worn, undetected, under street clothes.

In view of the above limitations, there is a need for a weighted garment that is comfortable to wear for extended periods of time while walking, running, bending, stretching, sitting, and so on.

BRIEF DESCRIPTION OF THE FIGURES

FIGS. 13 A and B are a front and back view of a bra with gel weighs along the spine and other weights along the lower band in front as counter weight.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the disclosure.

Also, it is to be understood that the phraseology and terminology used herein is for the purpose of description and should not be regarded as limiting. The use of "including," "comprising," or "having" and variations thereof herein are meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 2:
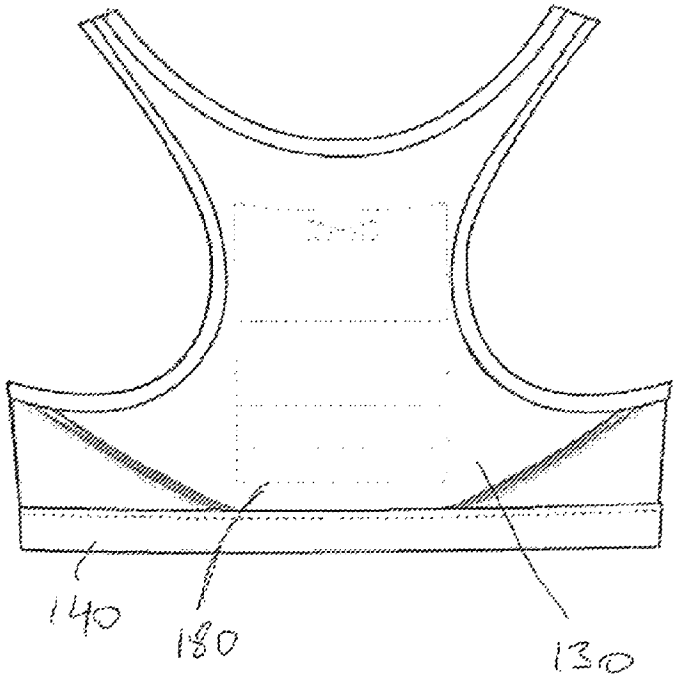
FIG. 2 depicts a back view of the garment in FIG. 1.
Figure 1:
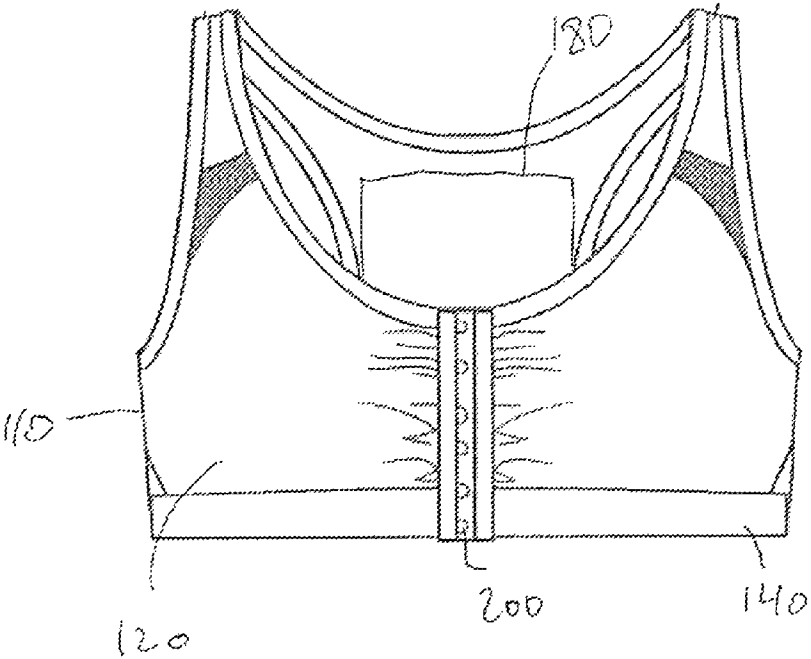
FIG. 1 depicts a front view of a garment according to the present disclosure.
Figure 3:
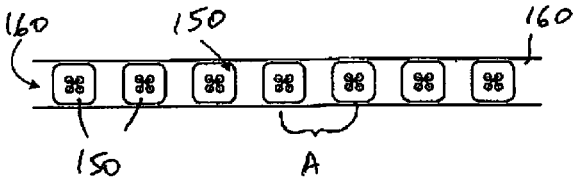
FIGS. 3-4 depict an elastic portion according to the present disclosure.
Figure 4:
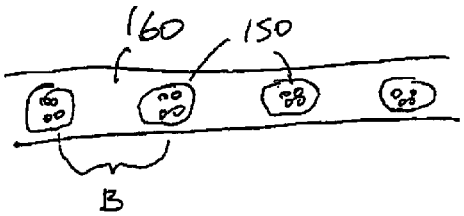

In some embodiments presently disclosed, a weighted garment 100 is shown in FIGS. 1-2. The garment 100 comprises a body 110 having a front section 120 and a back section 130. In some embodiments, the garment 100 further comprises an elastic portion 140. In some embodiments, the elastic portion 140 comprises a plurality of weights 150 coupled with an elastic material 160 as shown in FIG. 3. The plurality of weights 150 are separated by a distance A (shown in FIG. 3) when the garment 100 is not being worn by a user. The plurality of weights 150 are separated by a distance B (shown in FIG. 4) when the garment 100 is being worn by the user. Because the elastic material 140 stretches when the garment 100 is being worn by a user, the distance B is greater than the distance A. By being directly attached to an elastic portion of a garment, the weights can be held close to the wearer's body without necessarily requiring an outer layer of fabric.

Figure 5:
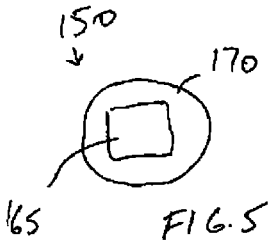
FIG. 5 depicts an insert according to the present disclosure.

In some embodiments, the weights 150 comprise metal, polymer, silicone, rubber and/or combination of these and/or other suitable materials. In some embodiments, at least one weight 150 comprises metal 165 incased in soft material 170 as shown in FIG. 5. In some embodiment, the soft material 170 is silicone, rubber, foam and/or combination of these and/or other suitable materials. In some embodiments, at least one weight 150 is sewn to, glued to, and/or Velcro with the elastic material 160. In some embodiments, the elastic material 160 comprises Nylon material, Spandex material, Jersey material, Polyester material, Cotton material and/or combination of any of these materials. In some embodiments, at least two of the weights 150 have different weights. In some embodiments, the plurality of weights 150 and the elastic material 160 are removably coupled with the elastic portion 140. In some embodiments, the plurality of weights 150 and the elastic material 160 are replaceable with another set of weights coupled with elastic material (not shown). In some embodiments the weights are fixed to the elastic material. In that case, there may be no need for inserts or pockets.

In some embodiments, the garment 100 optionally comprises at least one compartment 180 coupled with the back section 130. In some embodiment, the compartment 180 is coupled with an inner surface of the back section 130, wherein the inner surface of the back section 130 is the closest to the user's skin. In some embodiment, the compartment 180 is coupled with an outer surface of the back section 130, wherein the outer surface of the back section 130 is the farthest from the user's skin. In some embodiments, the compartment 180 is sewn to, glued to, and/or Velcroed with the back section 130. In some embodiments, the compartment 180 is removably coupled with the back section 130.

In some embodiments the weights comprise a gel that has small pieces of a heavy substance imbedded in it. This can make a weight that is flexible and sewable and that protects the body due to its softness and flexibility.

Figure 6:
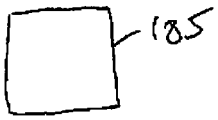
FIG. 6 depicts another insert according to the present disclosure.
Figure 7:
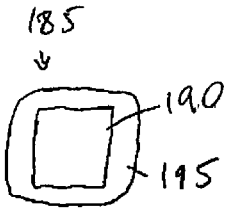
FIG. 7 depicts another insert according to the present disclosure.

In some embodiments, the compartment 180 is configured to accommodate at least one insert 185 as shown in FIG. 6. In some embodiments, the insert 185 comprises metal, polymer, silicone, rubber and/or combination of these and/or other suitable materials. In some embodiments, the insert 185 comprises metal 190 incased in soft material 195 as shown in FIG. 7. In some embodiment, the soft material 195 is silicone, rubber, foam and/or combination of these and/or other suitable materials.

In some embodiments, the insert 185 is removably coupled with the compartment 180. In some embodiments, the insert 185 is sewn to, glued to, and/or Velcro with the compartment 180. In some embodiments, additional inserts (not shown) are coupled with the compartment 180.

In some embodiments, the insert 185 is replaceable with another insert (not shown). In some embodiments, additional inserts (not shown) are coupled with the insert 185.

In some embodiments, the insert 185 is removably coupled with the garment 100. In some embodiment, the insert 185 is coupled with an inner surface of the garment 100, wherein the inner surface of the garment 100 is the closest to the user's skin. In some embodiment, the insert 185 is coupled with an outer surface of the garment 100, wherein the outer surface of the garment 100 is the farthest from the user's skin. In some embodiments, the insert 185 is sewn to, glued to, and/or Velcro with the garment 100. In some embodiments, the insert 185 is removably coupled with the garment 100. In some embodiments, additional inserts (not shown) are coupled with the garment 100. In some embodiments, additional inserts (not shown) are coupled between the insert 185 and the garment 100.

In some embodiments, the insert 185 is configured to provide padding and protection to the user's spine. The insert 185 allows for comfort in sitting and supine positions.

In some embodiments, the garment 100 comprises one or more coupling members 200 to allow the user to put-on and remove the garment 100. In some embodiments, the one or more coupling members 200 are clasps, hooks, buttons and/or any other appropriate fasteners.

Although the garment 100 is shown as a brassiere, it is to be understood that it can also be a vest, a t-shirt, a shirt, or any other clothing configured to be worn by a human being.

In some embodiments, the garment 100 comprises a high-lycra content fabric. In some embodiments, the back section 130 of the garment 100 comprises an inner layer, a middle layer(s) and an outer layer (not shown). The inner layer is in physical contact with the user's skin and comprises material washable, flexible, nonirritating material. In some embodiments, the middle layer comprises multiple layers. In some embodiments, the middle layer, disposed between the inner layer and the outer layer, is configured to support the insert 185. In some embodiments, the middle layer comprises elastic material (with recoil properties) configured to support the insert 185 firmly in position against the user's body. In some embodiments the one or more middle layers are coupled with the bottom of the bottom band or other areas of that band to provide increased support to the compartment 180 and/or insert 185. In some embodiments the outer layer is secured in a like manner. In some embodiments, the outer layer comprises elastic material configured to hold the insert 185 firmly against the user's body preventing movement of the insert 185 during activity.

In some embodiments, the garment 100 presently disclosed is designed to be worn by a man or woman during the normal course of his/her day and through his/her usual daily activities and routine including—but not limited to sports, physical activity, cleaning, gardening, shopping. This includes the full spectrum of workout routines common to men/women including—but not limited to yoga, pilates, walking, running, tennis, golf, hiking, martial arts, dance, biking.

In some embodiments, the garment 100 presently disclosed is designed to treat Osteoporosis by increasing bone mass and decrease risk of osteoporotic fractures; designed to treat generalized deconditioning to improve strength, balance and flexibility; designed to increased Body Mass Index (BMI); designed to treat functional Kyphosis (functional due to long hours bent over desk, computer, driving, etc.); designed to treat Scoliosis; designed to treat back pain due to stiffness and muscle spasm; designed to treat compression fractures and other painful thoracic spine pathologies; designed to treat anxiety and/or; designed to treat autism.

In some embodiments weights are arranged over and along either or both sides of the spine. In that case it can be advantageous to have soft, flexible weighs. One soft weight would be a gel impregnated with small pieces of a heavy metal such as lead. A mesh may be entrained in the gel creating a "sewable", soft, weight.

In some embodiments, the garment 100 presently disclosed is designed to sport a slim silhouette so that the man and/or woman can wear it throughout the day—including to his/her place of employment or to many social events—without it being noticeable. This allows the wearer to receive the therapeutic benefit for longer periods of time. Also allows for use during supine and inverted exercises as in Pilates or yoga.

In some embodiments, the garment 100 presently disclosed is configured to maintain therapeutic modality firmly against wearer's body with minimal to no shift in position during activity. This is to maintain spine in physiologic position.

In some embodiments, the garment 100 presently disclosed is fitted to wearer to provide a fitted garment and prevent unwanted movement of the weights 150 and/or inserts 185.

In some embodiments, the garment 100 presently disclosed employs incremental weight placement to help maintain neutral and physiologic spine position. This allows for use by deconditioned wearers, enhanced safety, maintenance of appropriate center of gravity, recruitment of the (smaller) muscles of the postural spine. Light and immobile weight placement over thoracic spine allows for (self) assisted stretch during targeted exercises resulting in increased flexibility to the user.

Figure 8:
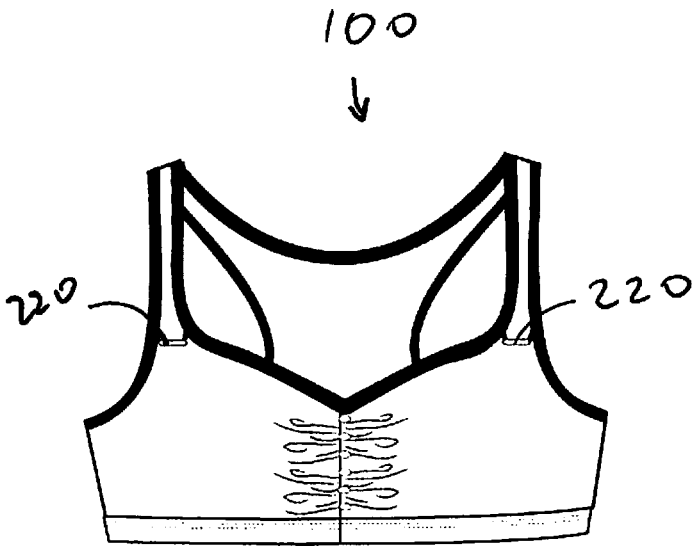
FIG. 8 depicts another garment according to the present disclosure.
Figure 9:
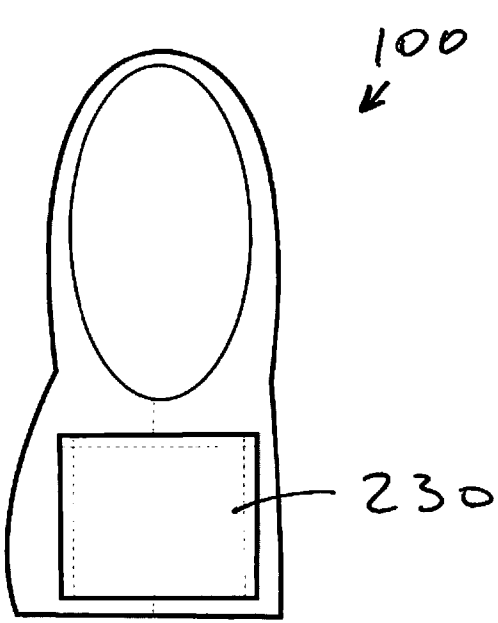
FIG. 9 depicts another garment according to the present disclosure.

In some embodiments, the garment 100 comprises adjustable straps 220 as shown in FIG. 8. In some embodiments, the garment 100 composes at least one compartment 230 positioned under the user's armpit where back section 130 and front section 120 are coupled with each other. In some embodiment, the compartment 230 is coupled with an inner surface of the garment 100, wherein the inner surface of the garment 100 is the closest to the user's skin. In some embodiment, the compartment 230 is coupled with an outer surface of the garment 100, wherein the outer surface of the garment 100 is the farthest from the user's skin. In some embodiments, the compartment 230 is sewn to, glued to, and/or Velcro with the garment 100. In some embodiments, the compartment 230 is removably coupled with the garment 100.

Figure 10:
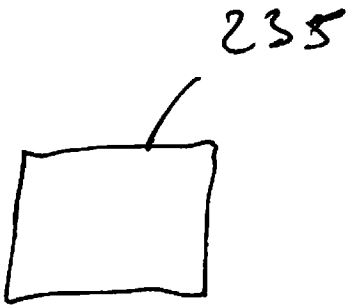
FIG. 10 depicts another insert according to the present disclosure.
Figure 11:
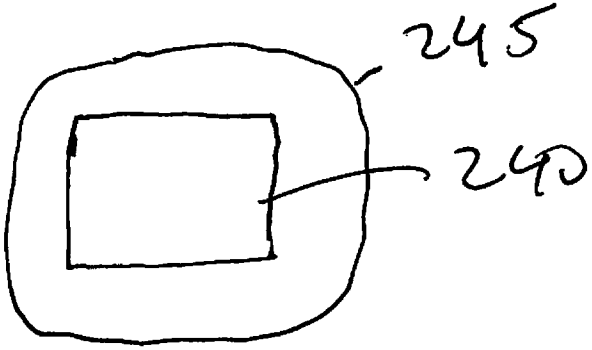
FIG. 11 depicts another insert according to the present disclosure.

In some embodiments, the compartment 230 is configured to accommodate at least one insert 235 as shown in FIG. 10. In some embodiments, the insert 235 comprises metal, polymer, silicone, rubber and/or combination of these and/or other suitable materials. In some embodiments, the insert 235 comprises metal 240 incased in soft material 245 as shown in FIG. 11. In some embodiment, the soft material 245 is silicone, rubber, foam and/or combination of these and/or other suitable materials.

In some embodiments, the insert 235 is removably coupled with the compartment 230. In some embodiments, the insert 235 is replaceable with another insert (not shown).

In some embodiments, the garment 100 comprises at least one breast compartment positioned under the user's breasts (not shown). In some embodiment, the breast compartment is coupled with an inner surface of the garment 100, wherein the inner surface of the garment 100 is the closest to the user's skin. In some embodiment, the compartment 230 is coupled with an outer surface of the garment 100, wherein the outer surface of the garment 100 is the farthest from the user's skin. In some embodiments, the breast compartment is sewn to, glued to, and/or Velcro with the garment 100. In some embodiments, the breast compartment is removably coupled with the garment 100.

In some embodiments, the breast compartment is configured to accommodate at least one breast insert (not shown). In some embodiments, the breast insert comprises metal, polymer, silicone, rubber and/or combination of these and/or other suitable materials. In some embodiments, the breast insert comprises metal incased in soft material (not shown). In some embodiment, the soft material is silicone, rubber, foam and/or combination of these and/or other suitable materials.

In some embodiments, the breast insert is removably coupled with the breast compartment. In some embodiments, the breast insert is replaceable with another insert (not shown).

In some embodiments, garment 100 is configured to position the inserts 185 at least partially over the thoracic spine posteriorly from T1-T12 and may extend laterally as far as the lateral aspect of the scapula. This allows the garment 100 to recruit and strengthen the muscles of the user's back and to weight load the user's spine. Muscles affected may include those responsible for posture, for spinal mobility, and muscles of the shoulder girdle. Examples include but are not limited to the paraspinal muscles, erector spinae, multifidus, trapezius, rhomboids, serratus anterior, levator scapulae. Weight loading of the user's spine helps to preserve bone mass density and to slow the age related loss of bone mass. Also this positioning of the weight serves to potentiate postural and upper body exercises by increasing the workload of the muscles involved. Stronger Back Muscles Reduce the Incidence of Vertebral Fractures.

In some embodiments, the presently disclosed garment is configured to strengthen back muscles whereby it has been found that strengthening of back muscles (markedly) decreases incidence/risk of vertebral fracture. In some embodiments, the presently disclosed garment is configured to increase level of activity, even if at a low level, whereby it has been found that even a low level of physical activity helps cut mortality risk. In some embodiments, the presently disclosed garment is configured to increase the number of calories burned each hour regardless of physical activity.

In some embodiments, the presently disclosed garment is configured to provide the benefits of strength training. Studies have shown that strength training benefits women and men of all ages and all levels of fitness. Experts agree that aerobic activities should be supplemented with strength training. Strength training will: build strength; maintain bone density; improve balance, coordination, and mobility; reduce your risk of falling; maintain independence in performing activities of daily life for the elderly and the debilitated.

There are numerous benefits to strength training regularly, particularly as you grow older. It can be very powerful in reducing the signs and symptoms of numerous diseases and chronic conditions, among them: arthritis; diabetes; osteoporosis; obesity; back pain; depression; insomnia.

In some embodiments, the presently disclosed garment is configured to provide convenience of workout allowing wearer to incorporate exercises in the normal routine of the day because it has been shown an exercise program incorporating strength and balance training into daily activities helped seniors maintain functional capacity better than traditional training.

In some embodiments, the presently disclosed garment is configured to help align posture to sagittal balance because it has been shown that correctly aligned posture helps to reduce back and joint pain.

In some embodiments, the garment is specifically designed with low level of weight to decrease stress to joints and spine.

Figure 12A:
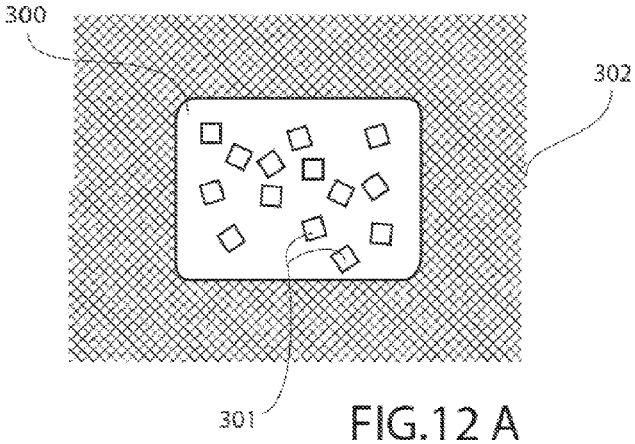
FIGS. 12 A B and C show, in a schematic form, a sewable, gel-based weight.
Figure 12B:
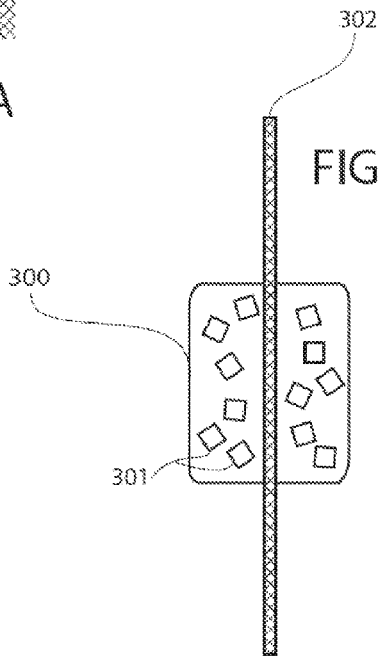
Figure 12C:
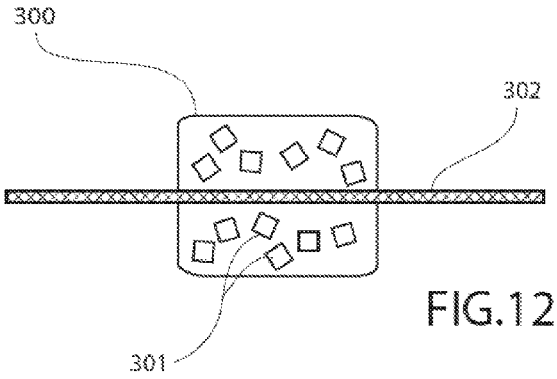

FIGS. 12 A, B, and C show, in a schematic form, a sewable, gel-based weight with gel 300, mesh 302 and metal particles 301.

FIGS. 13 A and B are a front and back view of a bra with gel weights along the spine and other weights along the lower band in front, as counter weight.

As shown, the garment is configured to be discreet, convenient, and comfortable.

In some embodiments, the presently disclosed garment or portions of garment are configured to fit in a manner providing deep touch pressure—functionally similar to that of Temple Grandin's hug box, swaddling of babies, or weighted vests and blankets used in autism to reduce anxiety and nervousness.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claimed element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "step(s) for . . . "

What is claimed is:

1. A garment or portion of a garment comprising:

a body comprised of fabric having a front portion and a back portion;

an elastic band coupled to the body; and at least two weights located on, distributed along and coupled to the elastic band, the at least two weights separated by a first distance when the garment is not being worn by a user, and wherein the at least two weights are separated by a second, longer distance when the garment is being worn by the user; and a plurality of back weights distributed and arranged along the back portion and configured to provide deep touch pressure compression to the user, the back weights arranged to be located over the small postural muscles of the thoracic spine of a user when worn, the back weights configured in mass and placement to conform to the fleshy part of a user's body and configured to provide targeted training of the small postural muscles of the user's thoracic spine when worn.

2. The garment or portion of a garment of claim 1, wherein the body and the elastic band are configured and arranged to extend around the torso of a user.

3. The garment or portion of a garment of claim 1, wherein the garment is a bra, and the elastic band is configured to be located proximate the user's lower ribcage.

4. The garment or portion of a garment of claim 1, wherein the plurality of back weights are incased in a soft material.

5. The garment or portion of a garment of claim 4, wherein the soft material is formed of one or more materials selected from the group consisting of a gel, a polymer, silicone, foam and rubber.

6. The garment or portion of a garment of claim 1, wherein the back weights are incrementally located along the back portion in an arrangement that is configured to treat kyphosis of the thoracic spine and aid in aligning posture to sagittal balance.

7. The garment or portion of garment of claim 1, wherein additional weights are coupled to the body and arranged to be located under the user's underarm when worn.

8. A therapeutic weighted posture bra to provide targeted training of the small muscles along the thoracic spine of a user to treat kyphosis and aid in alignment of the user's posture to sagittal balance, the bra comprising:

a body configured to cover a portion of a user, the garment having a front portion and a back portion, the garment extending from an upper end to a lower end;

a plurality of weights distributed and arranged along the body and configured to provide deep touch pressure compression of the weights to target the small postural muscles supporting the thoracic spine of a user when worn by the user to engage and train the small postural muscles of the thoracic spine, wherein the weights are movable relative to one another with movement of the vertebrae of the user's spine, the weights configured to move in a corresponding motion with the vertebrae of the user; and a plurality of counterweights arranged on the body and configured to be located under the breast of a user when worn.

9. The bra of claim 8, wherein the plurality of counterweights are located proximate the lower end, and are configured to contribute to supporting and lifting the breasts of the user.

10. The bra of claim 8, wherein the plurality of counterweights are distributed along and coupled to an elastic band, the at least two counterweights separated by a first distance when the garment is not being worn by a user, and where the at least two counterweights are separated by a second, longer distance when the garment is being worn by the user.

11. The bra of claim 8, wherein the counterweights are configured to be sewn onto an elastic band of the bra.

12. The bra of claim 8, wherein the plurality of counterweights are weighted breast inserts.

13. The bra of claim 8, wherein the plurality of counter counterweights are weighted breast inserts comprising a weight incased in a soft material.

14. The bra of claim 8, wherein the plurality of weights are configured and arranged such that the user may perform supine and inverted pilates and yoga exercises while wearing the bra.

15. A garment or portion of a garment to provide targeted training of small muscles along a thoracic spine of a user, the garment or portion of a garment comprising:

a body configured to cover a portion of a user, the garment having a front portion and a back portion, the garment extending from an upper end to a lower end;

a plurality of weights distributed and arranged along the body and configured to provide deep touch pressure compression of the weights to target the small postural muscles supporting the thoracic spine of a user when worn by the user to engage and train the small postural muscles of the thoracic spine, wherein the weights are movable relative to one another with movement of the vertebrae of the user's spine, the weights configured to move in a corresponding motion with the vertebrae of the user.

16. The garment or portion of a garment of claim 15 further comprising a plurality of counterweights arranged on the body and configured to be located under a breast of a user when worn.

17. The garment or portion of a garment of claim 15, further comprising a plurality of counterweights that are configured to contribute to supporting and lifting the breast of the user.

18. The garment or portion of a garment of claim 15, further comprising a plurality of counterweights distributed along and coupled to an elastic band, the at least two counterweights separated by a first distance when the garment is not being worn by a user, and where the at least two counterweights are separated by a second, longer distance when the garment is being worn by the user.

19. The garment or portion of a garment of claim 15, wherein the weights are arranged and configured to treat at least one of: kyphosis, scoliosis, back pain, muscle spasm and. compression fracture.

20. The garment or portion of a garment of claim 15, further comprising an elastic band comprising a plurality of counterweights, wherein the elastic band is configured and arranged to extend around the torso of a user to compress the counter weights against the torso of the user.

21. The garment or portion of a garment of claim 15, wherein the garment is a bra, and the elastic band is configured to be located proximate the user's lower ribcage.

* * * * *